US009370726B2

(12) United States Patent
Rybka

(10) Patent No.: US 9,370,726 B2
(45) Date of Patent: Jun. 21, 2016

(54) AIR CONE FLYER

(71) Applicant: Theodore Wesley Rybka, Sparks, NV (US)

(72) Inventor: Theodore Wesley Rybka, Sparks, NV (US)

( * ) Notice: Subject to any disclaimer, the term of this patent is extended or adjusted under 35 U.S.C. 154(b) by 44 days.

(21) Appl. No.: 14/280,735

(22) Filed: May 19, 2014

(65) Prior Publication Data

US 2015/0328560 A1 Nov. 19, 2015

(51) Int. Cl.
*A63H 27/00* (2006.01)
*A63H 33/18* (2006.01)

(52) U.S. Cl.
CPC ..... *A63H 33/18* (2013.01)

(58) Field of Classification Search
USPC ..... 446/46, 47, 48; 473/588, 589; D21/436, D21/443, 444
See application file for complete search history.

(56) References Cited

U.S. PATENT DOCUMENTS 3,359,000 A * 12/1967 Schreiber ..... F41J 3/0004 273/365
4,132,029 A * 1/1979 Thompson ..... A63H 33/18 446/48
4,212,131 A * 7/1980 Ross, Jr. ..... A63H 33/18 446/46
4,940,441 A * 7/1990 Novinsky ..... A63H 33/18 446/46
5,045,011 A * 9/1991 Lovik ..... A63H 33/18 273/114
D336,119 S * 6/1993 Bridge, Jr. ..... D21/443
5,269,716 A * 12/1993 Viola ..... A63H 33/18 446/48
D346,626 S * 5/1994 St. Lawrence ..... D21/443
5,676,581 A * 10/1997 Ziegler ..... A63H 33/18 446/240
D559,920 S * 1/2008 Krueger ..... D21/443

* cited by examiner

*Primary Examiner* — Kurt Fernstrom

(57) ABSTRACT

Air cone flyers are aerial toys that consist of a cone for the upper surface and an annular ring or disc for their base. They have a unique three dimensional shape for their upper surface and this convexity gives the units a large amount of airfoil lift. The outer part of the thin flat rim extends radially outward past the cone's base and gives the air cone low drag and this leads to longer fights. The air cones when thrown with spin are designed to achieve straight flights by balancing out the rolls of the two component parts. The flyers can experience buoyant flights due to their light weight, their three-dimensionality, and their associated airfoil lift. The light weight, soft and compressible foam rim which has rotational inertia is easy to throw and catch and is ideal for both indoor and outdoor areas.

7 Claims, 5 Drawing Sheets

AIR CONE FLYER

U.S. PATENT DOCUMENTS

| | | | |
|---|---|---|---|
| 6,179,737 | Alan J. Adler | January 2001 | air disc patents |
| 4,915,661 | William F. Getgy | April 1990 | |
| 4,479,665 | Alan J. Adler | October 1984 | |
| 4,279,097 | Gary W. Walker | July 1981 | |
| 3,563,548 | Carl Tolotti | February 1971 | |
| 3,544,113 | Kenneth E. Hand | December 1970 | |
| 2,798,722 | M. P. Fluhrer | July 1957 | |
| 4,104,822 | Henry Wendell Rodgers | June 1989 | air ring patents |
| 4,560,358 | Alan J. Adler | December 1985 | |
| 4,456,265 | Alan J. Adler | June 1984 | |
| 4,307,535 | Lucian D. Martin | December 1981 | |
| 3,765,122 | Roy English | October 1973 | |
| 3,580,580 | Wark & Schadermundt | May 1969 | |
| 4,568,297 | David B. Dunipace | February 1986 | circular |
| 4,253,269 | Richard A. Sullivan | March 1981 | airfoil |
| 3,959,915 | John S. Kettlestrings | June 1976 | patents |
| 3,724,122 | Richard L. Gillespie, Sr. | March 1973 | |
| 3,359,678 | Edward L. Headrick | December 1967 | |

PrimeProducts, Inc. also makes air disc units

BACKGROUND OF THE INVENTION

This invention relates to three dimensional aerial toys which when thrown with spin fly through the air. Related categories can be designated as air discs, air rings, and circular airfoils. The air cone does not fit into any of these designations as it has the unique feature of an outer thin flat circular rim and a large upper surface convexity not present in the other aerial toys. This makes the air cone a three dimensional toy while other aerial toys are only two dimensional or at best only slightly three dimensional. (Air discs) In Adler's U.S. Pat. No. 6,179,737 his disc has balanced aerodynamic lift which results in straight flights by having the center of aerodynamic lift and the center of gravity coincident for most of the flight and this is achieved by the unique feature of its rim.

The Getgy U.S. Pat. No. 4,915,661 is about a flying disc toy which is stable in horizontal and vertical and is designed for a game where one bounces the toy off walls or concrete surfaces.

Adler's U.S. Pat. No. 4,479,655 is a circular boomerang. It has three protruding tabs on the toy's circular periphery.

Walker's U.S. Pat. No. 4,279,097 is a soft playing disc of pliable material having a generally disc-cupped shape to provide for an aerodynamically stable disc.

Tolotti's U.S. Pat. No. 3,563,548 has a puck-like shape and is designed for pitching and batting. Hand's U.S. Pat. No. 3,544,113 is about a set of discs of differing densities used for buoyancy measurements.

Fluhrer's U.S. Pat. No. 2,798,722 is a small diameter disc of metal for playing hop scotch. (Air rings) Rodger's U.S. Pat. No. 4,104,822 is a rotating circular ring whose ring cross section indicates a cambered upper surface and a bottom cambered surface with a maximum body thickness at the center of the cross section.

Adler's U.S. Pat. No. 4,560,358 is a gliding ring toy comprised of a closed-figure airfoil with a narrow separator lip on the outer perimeter of the upper surface in order to balance the aerodynamic lift tore and aft, over a wide range of velocities in gliding flight.

Adler's U.S. Pat. No. 4,456,265 is a gliding ring toy comprised of an annular airfoil angled in order to compensate for air downwash effects and to balance the aerodynamic lift, fore and aft, in gliding flight.

Martin's U.S. Pat. No. 4,307,535 is an aerodynamic device for being launched for flight through the air and having three inherent parameters of rotation whereby a boomerang action is provided.

English's U.S. Pat. No. 3,765,122 is an annular ring flying toy with an outer skirt section. Flight is over an extensive path because the streaming air travels over the leading edge, is deflected downward by a circular deflector surface into the circular central opening and thereafter travels beneath the ring to the toy's trailing edge which is supported by and rides on the air stream that services as an air cushion.

Wark's and Schadermundt's U.S. Pat. No. 3,580,580 is a spinning aerial device or "flying saucer". It is a disc with a centered circular opening and has a plurality of concentric sections including an annular body section with downwardly extending flanges formed along the inner and outer edges of said body section.

(Circular airfoils) Dunipace's U.S. Pat. No. 4,568,297 has a design such that actual flight is increased by reducing drag, increasing lifting area and redistributing mass toward the rim. The rim is triangular shaped with high mass thereby reducing the spin necessary to achieve stable flight and allows for easier gripping. The upper and lower planes of the disc provide for stable flight configuration in various wind conditions. The convexity of the upper surface occurs only near the outer rim and the central area is flat.

Sullivan's U.S. Pat. No. 4,253,269 is a reversible aerodynamic disc. One feature is the rod like cylindrical configuration in the center providing a substantial amount of weight to the unit and providing flight stability.

Kettlestring's U.S. Pat. No. 3,959,916 uses a resilient elastic impeller to spin and propel a disc having aerodynamic characteristics. The circular disc is formed with its outer periphery surface convexed forming an airfoil. As the atmosphere passes over the top surface of the disk aerodynamic lift is created.

Gillespie's patent has considerable convexity in the upper surface, but also has a portion of the upper surface next to the rim that is depressed or concave which gives a low profile to the saucer and allows it the ability to "fly" at high speed.

Headrick's U.S. Pat. No. 3,359,678 is a saucer shaped throwing implement with a series of concentric discontinuities adjacent to the rim on the top side, the convex side, of the implement. The center of the top surface is substantially flat. "Spoilers" are used to created turbulent unseparated boundary layer which reduces the drag and increases flight stability.

Prime Products, Inc. has made an air disc which is flat in the central region but has a small shoulder height as one approaches the rim radius. However, this change in height at the shoulder is so slight that one can say this unit is essentially two dimensional. This unit flight tests for distances in the range of typical air discs on the market.

BRIEF DESCRIPTION OF THE DRAWINGS

FIG. 1 is a three dimensional view from a position lower than the air cone while

DETAILED DESCRIPTION OF THE DRAWINGS

Figure 1:
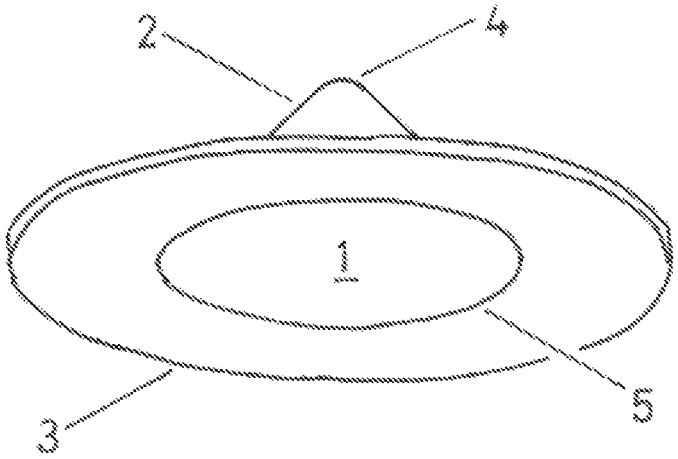
Figure 2:
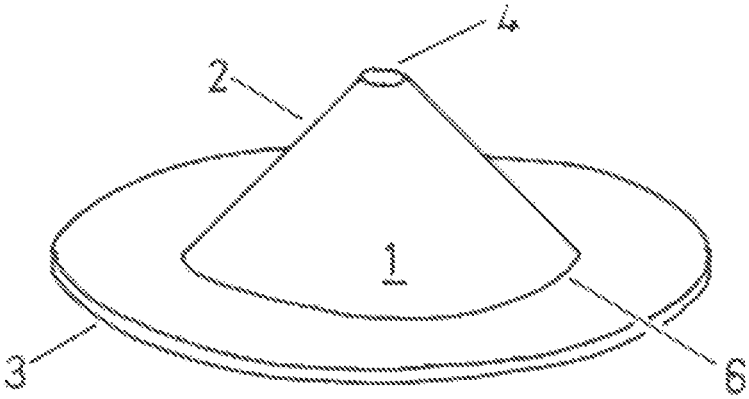
FIG. 2 is a three dimensional view from a position higher than the air cone.

Two three dimensional views of the air cone are shown. FIG. 1 shows a three dimensional view looking up to the air cone and FIG. 2 shows a three dimensional view looking down on the air cone. The assembled air cone 1 consists of a conical part 2 and an annular ring part 3. The central peak 4 has the shape of a small flat cap for better durability. The annular ring inner diameter 5 is such that it provides an inside lip of about % inch for gripping when throwing. The gluing circle 6 (FIG. 2) is shown on the assembled unit.

Before proceeding with discussing the drawings consider some background. First consider the gliding process. A glider starting at high elevation drops in elevation and gains forward speed. With the glider at horizontal or angled a small angle above the horizontal, the glider's wings deflect air downward with a resulting upward thrust on the glider. In this way the glider can fly level or nearly level through the air and only lose elevation slowly. If the glider has wings that are cambered on the upper surface, then there is an additional airfoil lift.

Now consider the powered flight of airplanes. Airplanes gain speed along a runway due to propeller thrust. The wings of airplanes are angled a few degrees above the horizontal to obtain lift by deflecting air downward with the bottom surfaces of their wings.

Figure 3:
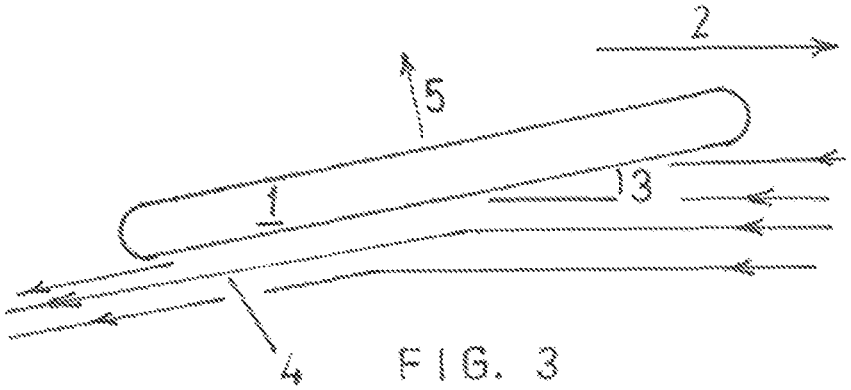
FIG. 3 is a side view of an air disc at a slight positive angle to the horizontal as it travels through the air.

In a somewhat similar manner to this, the air disc uses the forward motion imparted during launch and the deflection of air by its bottom surface to obtain lift in flight. FIG. 3 shows an air disc 1, launched with muscle power to give the air disc forward speed 2, and canted with a small positive angle 3 to the forward direction which allows the bottom surface to deflect the airflow downward 4 which results in an upward lift 5.

Consider again the powered flight of airplanes. When sufficient forward speed and altitude is obtained the angle of the airplane's wings is set to zero. In level flight the lift on the airplane is achieved by the convexity of the upper surface of its wings. The pressure on the upper cambered surface is less than the pressure on the essentially flat bottom surface. This difference in pressure between the upper and lower surfaces of the airplane's wings gives airfoil lift to the airplane.

Figure 4:
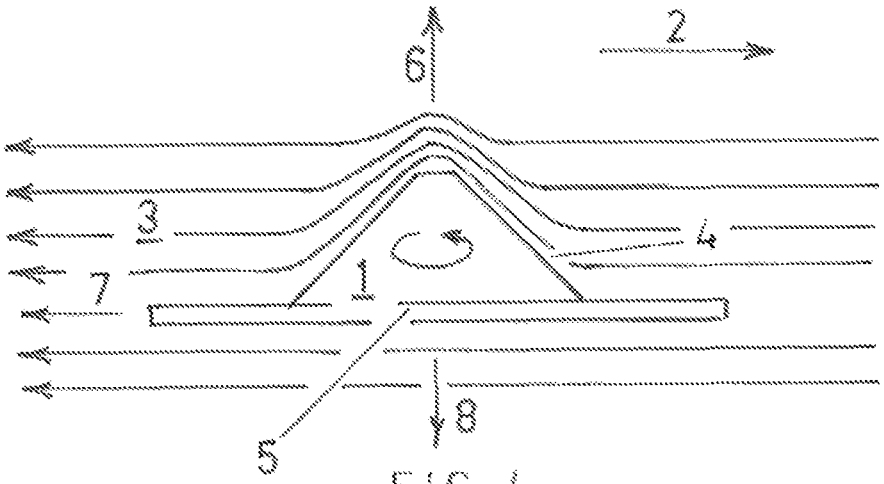
FIG. 4 is a side view of an air cone in a horizontal attitude as it travels through the air.

In a similar manner to the level flight of the airplane, the air cone has lift due to its three dimensional shape. FIG. 4 shows a vertical section of a spinning cone 1 in level forward flight 2 with airflow 3 around it, the conical upper contour 4, and the bottom flat surface of the thin rim 6 with the resulting airfoil lift 6 and the remaining forces of drag 7 and the weight 8.

By tilting the air cone so that it has a small positive angle to forward motion lift can also be obtained by deflecting the airflow downward by its flat bottom surface.

One measure of the three dimensionality of the circular geometry object is the ratio of its height to diameter. For air cones the height to diameter ratio can range from 0.125 to 0.5.

The Superdisc, U.S. Pat. No. 6,179,737 has a height to diameter ratio of 0.014, if one neglects the 0.75 Inch near vertical rim. So the Superdisc is essentially two dimensional. It achieves lift primarily through the principle of deflecting airflow. Regular air discs are even more two dimensional as the central part of the upper surface is flat and most of the vertical height change is in the rounding of the blunt rim.

The Innova air disc, U.S. Pat. No. 4,568,297 has a tapered edge but a flat central region. Its upper surface height to diameter ratio is 0.03. This is better than the Superdisc ratio and other air discs, but its heavy mass of 175 grams or 6 ounces dwarfs any resulting airfoil lift. Note by comparison a baseball weighs 5 ounces.

This author has made a wind lift indicator which is basically an air cone constrained to slide up and down a vertical shaft. In moderate wind conditions, the wind lifts light weight air cones up the shaft due to the airfoil of the air cone. This means that the lift on the air cone is equal to or greater than its weight; it is effectively weightless in the vertical dimension. Hence Its flight characteristics then should be similar to a buoyant object moving through the fluid of the air.

It seems reasonable to come up with a way to measure buoyancy. Let us call the airfoil lift to the weight of the aerial toy, the buoyancy ratio. If the ratio is near 1 or greater the aerial flyer is buoyant.

Air rings are annular rings, toroidal in shape. They have a large central opening with a small width outer rim. For air rings, it appears useful to define their three dimensionality as the ratio of the outer rim height to its width. This ratio for the Aerobee ring, U.S. Pat. No. 4,568,297 is near three dimensional. Hence it utilizes airfoil lift as well as airflow deflection lift and along with a low drag for forward flight it can go for long distances.

Other air ring patents are those by Martin U.S. Pat. No. 4,307,535, by English U.S. Pat. No. 3,765,122, Rodgers U.S. Pat. No. 4,104,822, and by Wark and Schadermundt U.S. Pat. No. 3,580,580. Their ratio of height to chord in the ring width dimensions indicate that they are near three dimensional. Hence they utilize airfoil lift as well as airflow deflection lift and along with a low drag to forward flight can also go for long distances. Note that the air cone is more three dimensional than the air ring and so the air cone is expected to have a larger airfoil lift than the air ring.

Air rings have a low three dimensionality. They also weigh about 110 grams and they are 2 to 3 times heavier than air cones. Thus one expects that their airfoil lift is much less than their weight. Accordingly, air rings are not very buoyant.

Air rings have no center and a very low vertical cross section and so are less visible in flight. If the air ring is in flight and viewed edge on it is almost invisible. In my opinion, the air ring does not present as pronounced or pleasing a silhouette in the sky as an air cone. Most throwing and catching of aerial toys is done in my experience at relatively short distances.

Because air rings go very fast and far, their time of flight over the first fifty feet of their flight is quite short whereas air cones have a longer time of flight over this initial distance. For short distances the air ring's brief time of flight, its quickness and low silhouette make it hard to catch. Air cones in flight can be viewed for longer times for short distances since they travel at slower speeds.

Thus, air cones have a longer flight time at short distances, a more pronounced sky silhouette and a range ideal for most throwing and catching in smaller outdoor areas or other outdoor confined spaces.

Some aerial toys can be classed as circular airfoils. They are three dimensional and so possess airfoil lift.

Headrick's Flying Saucer, U.S. Pat. No. 3,359,678 has 0.14 as the height to diameter ratio. Gillespie's Flying Saucer, U.S. Pat. No. 3,724,122 has 0.09 as the height to diameter ratio, if one neglects the 0.375-inch-thick blunt rim in height. Dunipace's Flying Disc U.S. Pat. No. 4,568,297 has 0.13 as the height to diameter ratio.

Typically, these units are from 8 to 9 inches in diameter. The weight of these airfoils is around 3 ounces or more, which is 2 to 3 times heavier than the typical weight of air cones, Although circular airfoils have a modest airfoil lift, because of their heavier weight they have a low airfoil to weight ratio and so do not have the buoyant flight characteristics exhibited by air cones. It should be noted that some circular airfoils have a convex bottom surface which reduces the lift effect of the upper surface.

Figure 5:
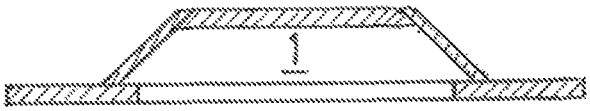
FIG. 5 is a vertical section which shows a unit with a truncated cone which I call an air mesa.

Of the three classifications of aerial toys discussed in this patent, the air cone most closely fits into the circular airfoil category. However, the air cone differs markedly from the circular airfoil in that the air cone has a thin, flat and light weight outer rim, while the circular airfoil has a blunt heavy rim. The air cone has a large height change in the central part of the upper surface while the airfoil is mostly flat in the center and has the height change in the tapering of the outer rim. The air cone has a flat bottom surface while some of the circular airfoils have some convexity in their bottom surface. The air mesa which is a variation of the air Lone has a truncated cone for its top part. It closely resembles an inverted saucer in shape. See FIG. 5 which is a vertical section of an air mesa. Hence the term "flying saucer" is most appropriate when talking about air cones and air mesas.

Air cones because of their low rim weight have a low rotational inertia. This low rotational inertia together with its light weight, make the air cone easy to throw with spin.

How to handcraft air cone flyers: The following instructs how to handcraft units that are 8 inches in diameter, with a 45-degree slope rim angle and with a 90-degree central peak angle in a vertical section. This unit is made with lightweight materials, such as foam and construction paper and weighs only 0.7 ounce.

Cone Part: Cut out a 6-inch diameter circle out of construction paper which is about 0.012 inch thick. From this circle cut out a 95-degree sector. Glue the two straight edges together with 10 degrees of overlap to form a cone 4½ inches in diameter at its base. Appropriately constrain the unit while the glue is drying so that a circular cone is formed.

Cut out a wedge from the construction paper the size of the overlap area and glue the wedge inside on the opposite side of the overlap. At an appropriate place in the procedure a small section of the peak is removed and replaced with a ⅜-inch diameter cap. This is for more durability and ease in certain styles of catching.

Rim Part: On the ¼ inch thick foam sheet mark out a 4 inch radius circle, a 2¼ inch radius circle and a 1⅞ inch radius circle. All circles are to have the same center. Cut out the 4 inch circle and the 1⅞ inch circle. Do not cut out the 2¼ inch circle but leave it as an alignment circle during the assembly phase.

Assembly: Place the cone on the foam rim circle so that it is concentric with the 2¼ inch radius alignment circle. Glue the cone in place. Refer to FIG. 2

At appropriate places in fabrication, do the artwork of circles, straight lines and other simple designs with a permanent ink marker. Finish by attaching name label to the top surface and information labels to the bottom surface.

Units could be built that have larger diameters, rim angles other than 45 degrees and with larger weights, say 2 to 5 ounces. Note other materials could be used for forming cones such as thin plastic sheet instead of construction paper, and balsa wood instead of foam for the rim part.

Various Models: Air cones are three dimensional and have symmetry about their vertical axes. Models dial have been fabricated and flight tested are shown in drawings, FIG. 6A axes. FIG. 6F. FIG. 6G and FIG. 6H have not yet been fabricated. Most models can be made with an opening in the circular base. However, the models in FIG. 6C and in FIG. 6D seem to perform better with no opening in the circular base.

Figure 6A:
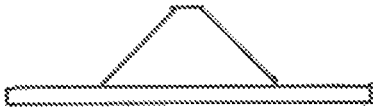
FIGS. 6A through 6H show side views of various three dimensional structures atop a circular disc.
Figure 6B:
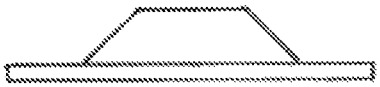

FIG. 6A shows a cone with a rim extending past its base. FIG. 6B shows a truncated cone with a rim extending past its base (an air mesa).

Figure 6C:
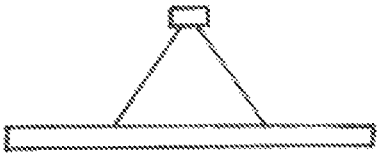
Figure 6D:
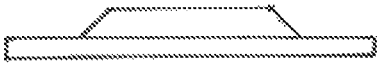

Two very different shapes when put together as shown in FIG. 6C perform quite well. FIG. 6D is just a solid disc as the base with a slanted ring of appropriate width and diameter attached to the upper surface. It flight tests well.

Figure 6E:
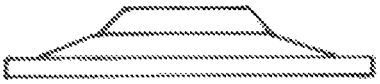
Figure 6F:
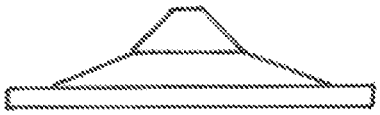
Figure 6G:
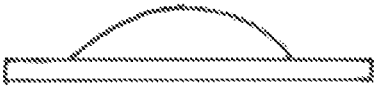
Figure 6H:
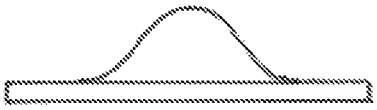

FIG. 6E shows a double slope air mesa, bowed inward. It flight tests well and has a slightly longer range than the unit shown in FIG. 6B. The double slope air mesa of FIG. 6E could be modified by putting a 135-degree central angle cone, in vertical section, on the top surface. This modification could possibly increase the unit's range. FIG. 6F is an air cone that is double sloped. A few units have been built.

FIG. 6G has an upper surface contour that is curved like the arc of a circle, in vertical section, and FIG. 6H has an upper contour that is also curved and like a double "s" curve, in vertical section.

Note all the models just discussed have thin, flat rims extending outward past the base of the cones. This feature is unique to this patent. However, there does exist a design where the base of the cone is coincident with the outer periphery of the annular ring base. That is, in that design there is no thin flat rim extending past the base of the cone. For this design it is expected that the rim angle in vertical section would be very small.

Method for Achieving Reasonably Straight Flights: The air cone is a composite of two geometric shapes, a cone and a flat annular ring. The flat annular ring is attached concentrically to the base of the cone and the ring extends radially outward from the base of the cone.

If the annular ring, by itself, is thrown with clockwise spin, it rolls to the left. If the cone, by itself, is thrown with clockwise spin, it rolls to the right.

Figure 7A:
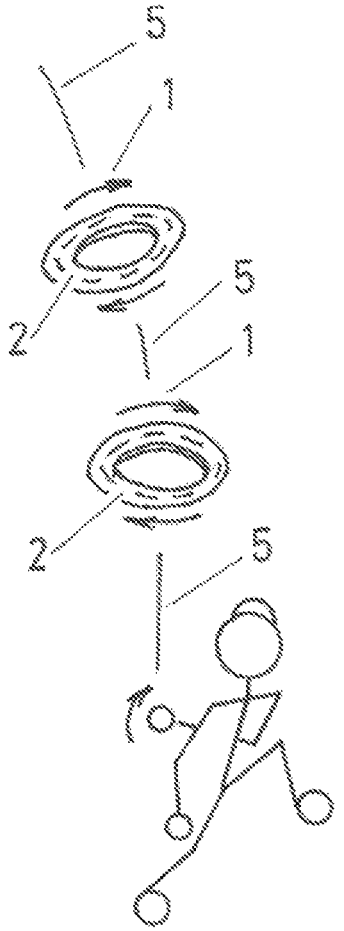
FIG. 7A is an elevated view from behind a "stickman" throwing right handed an annular ring which veers to the left.
Figure 7B:
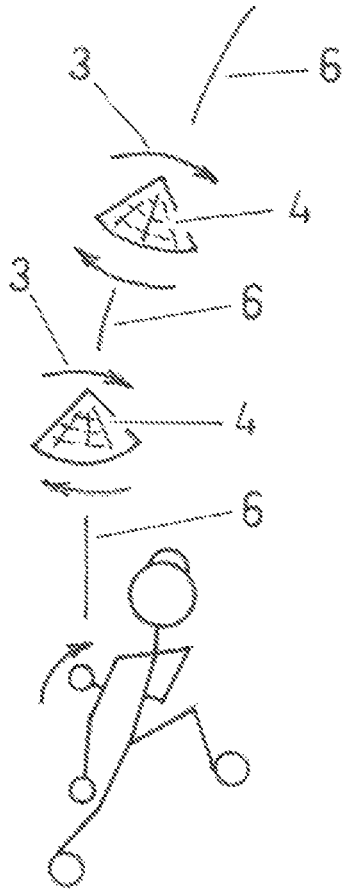
FIG. 7B is the same view has the "stickman" throwing right handed a cone and it veers to the right.

FIG. 7A shows an elevated back view of a right-handed person throwing with clockwise spin 1 a flat ring 2. FIG. 7B shows an elevated back view of a right-handed person throwing with clockwise spin 3 a cone 4. The flight path 5 of the ring rolls to the left, while flight path 6 of the cone rolls to the right.

In the composite structure, the ring is attached to the cone base. Since the rolls of the two component parts are opposite and if they are made near equal in magnitude, the resultant roll of the composite structure will be small and less than the magnitude of either of the component rolls. If the air cones are designed so that the two component rolls which are opposite in direction, are made equal in magnitude, then the resultant roll is zero.

Figure 8:
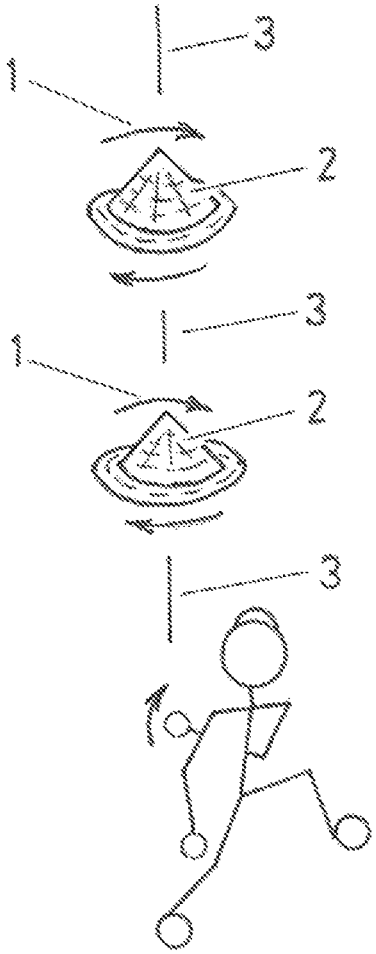
FIG. 8 is again the same view but has the "stickman" throwing the composite assembly of annular ring and cone and which is designed to fly in a straight trajectory when viewed from directly below the unit.

The roll of the air cone can be made zero or very small for a suitable span of forward speeds and spins. FIG. 8 shows an elevated back view of a right-handed person throwing with clockwise spin 1, air cone 2. An idealized straight flight path 3 is shown.

The design idea for balancing the opposite rolls of the two parts in order to produce straight flights that is flight paths that lie in a vertical plane is to increase or decrease the surface area of the conical part with respect to the surface area of the flat rim. Throw tests using what are considered desirable spins and forward speeds can be used to Indicate what the relative sizes of the two surface areas should be in order to achieve good flight paths.

Note that for clockwise spins, increasing the forward speed increases the roll to the right, while increasing the clockwise spin increases the roll to the left. Also note that thin flat discs, that are discs without a central opening in them, can also be used to form the base part of these flyers, instead of annular rings or rims.

Throwing Instructions: Air cone flyers are light weight and have a low rotational inertia when compared to air discs. In order to achieve typically good flights:

throw air cones with high spin and with the plane of the rim level or tilted up slightly above the horizontal in the direction of flight when launching the air cone do not have the plane of the rim tilted to the left or to the right when launching do not impart roll to the air cone to correct for roll adjust the spin and/or the forward speed before throwing, check to see that the foam rim is flat, not warped and straighten out the foam rim if necessary The different models varied in weight from about 0.7 ounce to 1.5 ounces. Typical flight distances varied from about 25 feet to 60 feet. A flight was considered to be reasonably straight if the flight path was stable and straight or mostly in a vertical plane and if the roll was moderate especially during the first part of the flight path. This I consider a reasonably straight flight path.

Although the air cone units are designed to give reasonably straight flights for typical spins and launch speeds, various roll correction items can be added to further improve the straightness of the flight. Some roll correction add-ons are tabs, slats, slanted rings, flat annular rings, small sharp-peaked cones atop the upper surface and added weights placed at various parts of the unit's surface.

Air cone flyers provide excellent outdoor exercise for children, youth and adults. Throwing, catching, walking, running and jumping provide a good work out for various muscles. Because of the light weight compressible foam rim, air cones have a low impulse so that "soft" hits and "soft" catches result. It follows that air cones can be used for indoor group activity in gymnasiums, in large halls, and other indoor recreational areas.

Air cone flyers are educational. They expose the user to various geometric shapes such as circles, cones and triangles. They help the user understand the basics of flight such as how do airplane wings keep the airplane in the air and what forces art on an object in flight.

The invention claimed is:

1. A flying toy, comprising:

an upper surface comprising a central portion formed of a first lightweight material, wherein the central portion has a cone-shaped surface or other convex surface, has a height and is symmetrical about its vertical axis;

a thin, flat annular ring formed of a second lightweight material, said annular ring having an outer diameter of at least eight inches; and a means for fastening the annular ring to the central portion such that the annular ring encircles the central portion;

wherein the overall weight of the flying toy is between 0.7 ounces and 1.5 ounces.

2. The flying toy of claim 1, wherein the first lightweight material is construction paper or a thin plastic sheet.

3. The flying toy of claim 1, wherein the second lightweight material is foam.

4. The flying toy of claim 1, wherein the means for fastening the annular ring to the central portion is glue.

5. The flying toy of claim 1, wherein the thickness of the cone-shaped central portion is 0.012 inches.

6. The flying toy of claim 1, wherein the thickness of the annular ring is 0.25 inches.

7. The flying toy of claim 1, wherein the ratio of the height of the central portion to the height to the outer diameter of the annular ring is between 0.125 and 0.5.

* * * * *